US006046147A

United States Patent [19]

Cassady et al.

[11] Patent Number: 6,046,147

[45] Date of Patent: Apr. 4, 2000

[54] PROCESS FOR MAKING SKIN CLEANSING COMBINATION SOAP BARS AND CLEANSING LIQUIDS

[75] Inventors: Timothy J. Cassady, Hamilton; Robert R. Schoettker, Cincinnati, both of Ohio

[73] Assignee: Henkel Corporation, Gulph Mills, Pa.

[21] Appl. No.: 08/892,393

[22] Filed: Jul. 14, 1997

Related U.S. Application Data

[60] Provisional application No. 60/023,391, Aug. 13, 1996.

[51] Int. Cl.[7] ..... C11D 9/04; C11D 9/60

[52] U.S. Cl. ..... 510/153; 510/141; 510/151; 510/152; 510/155; 510/156; 510/470; 510/491; 510/495

[58] Field of Search ..... 510/151, 152, 510/153, 154, 155, 156, 141, 130, 470, 495, 491, 536

[56] References Cited

U.S. PATENT DOCUMENTS

| | | | |
|---|---|---|---|
| 4,832,861 | 5/1989 | Resch | 252/106 |
| 5,076,953 | 12/1991 | Jordan et al. | 252/108 |
| 5,109,127 | 4/1992 | Sekiguchi et al. | 536/115 |
| 5,174,927 | 12/1992 | Honsa | 252/543 |
| 5,190,747 | 3/1993 | Sekiguchi et al. | 424/56 |
| 5,223,179 | 6/1993 | Connor et al. | 252/548 |
| 5,262,079 | 11/1993 | Kacher et al. | 252/112 |
| 5,264,144 | 11/1993 | Moroney et al. | 252/117 |
| 5,310,542 | 5/1994 | Au et al. | 424/52 |
| 5,332,528 | 7/1994 | Pan et al. | 252/548 |
| 5,338,491 | 8/1994 | Connor et al. | 252/548 |
| 5,352,386 | 10/1994 | Rahman et al. | 252/548 |
| 5,352,387 | 10/1994 | Rahman et al. | 252/548 |
| 5,358,656 | 10/1994 | Humphreys et al. | 252/174.12 |
| 5,393,449 | 2/1995 | Jordan et al. | 252/121 |
| 5,433,883 | 7/1995 | Massaro et al. | 252/174.17 |
| 5,500,155 | 3/1996 | Weuthen et al. | 252/557 |
| 5,712,235 | 1/1998 | Nieendick et al. | 510/151 |

FOREIGN PATENT DOCUMENTS

| | | |
|---|---|---|
| 0463912 | 1/1992 | European Pat. Off. . |
| 0550279 | 7/1993 | European Pat. Off. . |
| 0550280 | 7/1993 | European Pat. Off. . |
| 0550281 | 7/1993 | European Pat. Off. . |

*Primary Examiner*—Mark Kopec
*Assistant Examiner*—Gregory E. Webb
*Attorney, Agent, or Firm*—John E. Drach; Steven J. Trzaska

[57] ABSTRACT

A surfactant composition consisting essentially of: (a) from about 20 to about 63% by weight of an acyl isethionate; (b) from about 3 to about 52% by weight of a nonionic sugar surfactant selected from the group consisting of alkyl glucose esters, aldobionamides, gluconamides, glyceramides, glyceroglycolipids, polyhydroxy fatty acid amides, alkyl polyglycosides having the general formula I:

$$R_1O(R_2O)_b(Z)_a \qquad \text{I}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6, and mixtures thereof; (c) from about 7 to about 23% by weight of a free fatty acid; and (d) remainder, water, all weights being based on the weight of the surfactant composition.

34 Claims, No Drawings

PROCESS FOR MAKING SKIN CLEANSING COMBINATION SOAP BARS AND CLEANSING LIQUIDS

BENEFIT OF EARLIER FILING DATE UNDER 37 CFR 1.78(A)(4)

This application claims the benefit of earlier filed and copending provisional application Ser. No. 60/023,391, filed on Aug. 13, 1996.

FIELD OF THE INVENTION

The present invention generally relates to personal cleansing bars and liquids. More particularly, the present invention is directed to a process for incorporating acyl isethionates into personal cleansing bars and liquids.

BACKGROUND OF THE INVENTION

The cleansing of skin with surface-active cleansing preparations has become a focus of great interest. Many people wash and scrub their skin with various surface-active preparations several times a day. Ideal skin cleansers should cleanse the skin gently, causing little or no irritation, without defatting and overdrying the skin or leaving it taught after frequent routine use. Most lathering soaps, liquids and bars included, fail in this respect.

Synthetic detergent bars, frequently referred to as "syndet bars", are well known and are becoming increasingly popular. However, widespread replacement of soap bars by syndet bars has not so far been possible for a variety of reasons, primarily the poor physical characteristics of syndet bars as compared to soap bars. In clear distinction from syndet bars which are "soap-free" are the so-called "combo" bars which are combinations of fatty acid salts and synthetic detergents. One type of combo bar is produced by combining fatty acid soaps with salts of acyl isethionates. These combo bars, because they contain both a synthetic detergent and a soap component, do not suffer from the poor physical characteristics of syndet bars, and are milder to human skin than traditional fatty acid soaps.

However, a problem encountered in manufacturing combo bars relates to the incorporation of the synthetic acyl isethionates surfactant into the fatty acid soap. Acyl isethionates are high melting solids with low solubility in either water or organic solvents. Aqueous solutions of sodium cocoyl isethionate are inherently highly viscous. Thus, it is very difficult to incorporate acyl isethionates into soap formulations without the attendant physical disadvantages associated with their poor handling properties.

SUMMARY OF THE INVENTION

The present invention is directed to a novel surfactant composition containing:

(a) from about 20 to about 30% by weight of an acyl isethionate;

(b) from about 3 to about 52% by weight of a nonionic sugar surfactant selected from the group consisting of alkyl glucose esters, aldobionamides, gluconamides, glyceramides, glyceroglycolipids, polyhydroxy fatty acid amides, alkyl polyglycosides having the general formula I:

$$R_1O(R_2O)_b(Z)_a \qquad \text{I}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6, and mixtures thereof;

(c) from about 7 to about 23% by weight of a free fatty acid; and (d) remainder, water, all weights being based on the total weight of the surfactant composition.

The present invention is also directed to a novel process for incorporating acyl isethionate salts into fatty acid soap formulations. The process involves combining a $C_8$–$C_{22}$ fatty acid salt with the above-disclosed surfactant composition.

The present invention also provides a process for making a personal cleansing bar involving the steps of:

(a) providing a $C_8$–$C_{22}$ fatty acid salt;

(b) providing a surfactant composition, the composition containing:

(i) from about 20 to about 63% by weight of an acyl isethionate;

(ii) from about 3 to about 52% by weight of a nonionic sugar surfactant selected from the group consisting of alkyl glucose esters, aldobionamides, gluconamides, glyceramides, glyceroglycolipids, polyhydroxy fatty acid amides, alkyl polyglycosides having the general formula I:

$$R_1O(R_2O)_b(Z)_a \qquad \text{I}$$

wherein $R_1$ is a monovalent organic radical having from about 6 to about 30 carbon atoms; $R_2$ is a divalent alkylene radical having from 2 to 4 carbon atoms; Z is a saccharide residue having 5 or 6 carbon atoms; b is a number having a value from 0 to about 12; a is a number having a value from 1 to about 6, and mixtures thereof;

(iii) from about 7 to about 23% by weight of a free fatty acid;

(iv) remainder, water, all weights being based on the weight of the surfactant blend; and (c) combining components (a) and (b) to form a personal cleansing composition; and (d) processing the personal cleansing composition into a personal cleansing bar.

DESCRIPTION OF THE INVENTION

Other than in the operating examples, or where otherwise indicated, all numbers expressing quantities of ingredients or reaction conditions used herein are to be understood as being modified in all instances by the term "about".

The surfactant blend of the present invention comprises a combination of an acyl isethionate, a nonionic sugar surfactant, a fatty acid, and water. It has surprisingly been found that the use of this type of blend, due to its exceptional fluidity characteristics, enables acyl isethionates to be more easily incorporated into neat soap formulations, for the preparation of personal cleansing bars and liquids having exceptional lathering and skin sensitivity properties.

The acyl isethionates which may be employed in the present invention correspond to general formula II:

$$RCO—OCH_2CH—SO_3Z \qquad \text{II}$$

wherein RCO is a linear or branched acyl radical having from about 6 to about 22 carbon atoms and Z is selected from the group consisting of an alkali metal, an alkaline earth metal and ammonium. These esters may be prepared by reacting an alkali metal, alkaline earth metal or ammonium isethionate with a mixture of aliphatic fatty acid(s) having from 8 to 22 carbon atoms. In a particularly preferred embodiment, the acyl isethionate is sodium cocoyl isethionate.

The free fatty acids employed in the surfactant blend of the present invention are carboxylic acids derived from or contained in an animal or vegetable fat or oil. They are composed of a chain of alkyl groups containing from 8 to 22 carbon atoms and are characterized by a terminal carboxyl group. A particularly preferred free fatty acid for use in the present invention is a stripped coconut fatty acid wherein the volatile components of coconut fatty acid are removed by distillation.

The term nonionic sugar surfactant as used herein refers to surfactants that are based on saccharide moieties. The nonionic sugar surfactants which may be employed in the present invention are selected from the group consisting of alkyl polyglycosides, alkyl glucose esters, aldobionamides, gluconamides, glyceramides, glyceroglycolipids, polyhydroxy fatty acid amides, and mixtures thereof.

Preferred alkyl polyglycosides which can be used as the complexing agent in the concentrate of the invention have the formula I:

$$R_1O(R_2O)_b(Z)_a \qquad \text{I}$$

wherein Z is a glucose residue and b is zero. Such alkyl polyglycosides are commercially available, for example, as GLUCOPON®, or PLANTAREN® surfactants from Henkel Corporation, Ambler, Pa., 19002. Examples of such surfactants include but are not limited to:

1. GLUCOPON® 225 Surfactant—an alkyl polyglycoside in which the alkyl group contains 8 to 10 carbon atoms and having an average degree of polymerization of 1.7.
2. GLUCOPON® 425 Surfactant—an alkyl polyglycoside in which the alkyl group contains 8 to 16 carbon atoms and having an average degree of polymerization of 1.6.
3. GLUCOPON® 625 Surfactant—an alkyl polyglycoside in which the alkyl group contains 12 to 16 carbon atoms and having an average degree of polymerization of 1.6.
4. APG® 325 Surfactant—an alkyl polyglycoside in which the alkyl group contains 9 to 11 carbon atoms and having an average degree of polymerization of 1.6.
5. GLUCOPON® 600 Surfactant—an alkyl polyglycoside in which the alkyl group contains 12 to 16 carbon atoms and having an average degree of polymerization of 1.4.
6. PLANTAREN® 2000 Surfactant—an alkyl polyglycoside in which the alkyl group contains from 8 to 16 carbon atoms and having an average degree of polymerization of 1.4.
7. PLANTAREN® 1300 Surfactant—a $C_{12}$–$C_{16}$ alkyl polyglycoside in which the alkyl group contains 12 to 16 carbon atoms and having an average degree of polymerization of 1.6.

Other examples include alkyl polyglycoside surfactant compositions which are comprised of mixtures of compounds of formula I wherein Z represents a moiety derived from a reducing saccharide containing 5 or 6 carbon atoms; a is a number having a value from 1 to about 6; b is zero; and $R_1$ is an alkyl radical having from 8 to 20 carbon atoms. The compositions are characterized in that they have increased surfactant properties and an HLB in the range of about 10 to about 16 and a non-Flory distribution of glycosides, which is comprised of a mixture of an alkyl monoglycoside and a mixture of alkyl polyglycosides having varying degrees of polymerization of 2 and higher in progressively decreasing amounts, in which the amount by weight of polyglycoside having a degree of polymerization of 2, or mixtures thereof with the polyglycoside having a degree of polymerization of 3, predominate in relation to the amount of monoglycoside, said composition having an average degree of polymerization of about 1.8 to about 3. Such compositions, also known as peaked alkyl polyglycosides, can be prepared by separation of the monoglycoside from the original reaction mixture of alkyl monoglycoside and alkyl polyglycosides after removal of the alcohol. This separation may be carried out by molecular distillation and normally results in the removal of about 70–95% by weight of the alkyl monoglycosides. After removal of the alkyl monoglycosides, the relative distribution of the various components, mono- and polyglycosides, in the resulting product changes and the concentration in the product of the polyglycosides relative to the monoglycoside increases as well as the concentration of individual polyglycosides to the total, i.e. DP2 and DP3 fractions in relation to the sum of all DP fractions. Such compositions are disclosed in U.S. Pat. No. 5,266,690, the entire contents of which are incorporated herein by reference.

Other alkyl polyglycosides which can be used in the compositions according to the invention are those in which the alkyl moiety contains from 6 to 18 carbon atoms and in which the average carbon chain length of the composition is from about 9 to about 14 comprising a mixture of two or more of at least binary components of alkylpolyglycosides, wherein each binary component is present in the mixture in relation to its average carbon chain length in an amount effective to provide the surfactant composition with the average carbon chain length of about 9 to about 14 and wherein at least one, or both binary components, comprise a Flory distribution of polyglycosides derived from an acid-catalyzed reaction of an alcohol containing 6–20 carbon atoms and a suitable saccharide from which excess alcohol has been separated. The alkyl polyglycoside of the present invention acts as the complexing agent for the iodine complex concentrate.

The alkyl glucose ester sugar surfactants are generally disclosed in U.S. Pat. Nos. 5,109,127 and 5,190,747, the entire contents of both of which are incorporated herein by reference. These sugar surfactants have the general formula III:

III

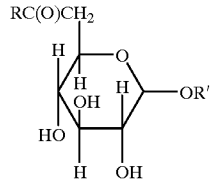

wherein R represents a fatty acid residue of 6 to 20 carbon atoms, preferably 6 to 12 carbon atoms and $R^1$ represents an alkyl group having 2 to 6 carbon atoms. Representative examples of such alkyl glucose esters are 1-ethyl-6-caprylglucoside, 1-ethyl-6-laurylglucoside, 1-butyl-6-caprylglucoside, 1-ethyl-6-palmitylglucoside and 1-ethyl-6-oleylglucoside.

The aldobionamide sugar surfactants are generally disclosed in U.S. Pat. No. 5,310,542 and in published European Patent Application No. 550,281, both of which are incorporated herein by reference. An Aldobionamide is generally defined as the amide of an aldobionic acid or aldobionolactone and an aldobionic acid in turn is defined as a sugar substance (e.g. any cyclic sugar) in which the aldehyde group has been replaced by a carboxylic acid which upon drying is capable of cyclizing to form an aldonolactone. The aldobionamides can be based on compounds comprising two saccharide units, e.g. lactobionamides, maltobionamides, cellobionamides, melibionamides, or gentiobionamides, or they can be based on compounds comprising more than two saccharide units provided that the polysaccharide has a terminal sugar unit with an aldehyde group available.

The preferred aldobionamides of the present invention are lactobionamides of the formula IV:

IV

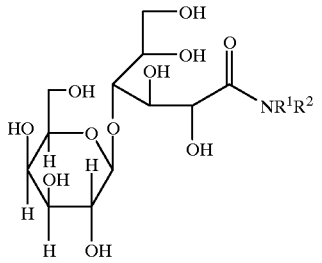

wherein $R^1$ and $R^2$ are the same or different and are selected from hydrogen and an aliphatic hydrocarbon radical containing up to about 36 carbon atoms (e.g. alkyl groups and alkenyl groups which groups may also include a heteroatom such as N, O, S, present, for instance, as an amide, carboxy, ether and/or saccharide moiety) except that $R^1$ and $R^2$ cannot simultaneously be hydrogen. The aliphatic hydrocarbon radical preferably contains up to 24 carbon atoms, most preferably from 8 to 18 carbon atoms. Representative examples of such lactobionamides are N-propyl lactobionamide, N-pentyl lactobionamide, N-decyl lactobionamide, N-hexadecyl lactobionamide, N-oleyl lactobionamide, N-dodecyl-N-methyl lactobionamide, and N-dodecyloxypropyl lactobionamide.

The gluconamide sugar surfactants are generally disclosed in U.S. Pat. No. 5,352,386, the entire contents of which is incorporated herein by reference. These surfactants have the general formula V:

$$HOCH_2—(CHOH)_m—C(O)—NHR \quad V$$

wherein m is an integer from 2 to 5; and R is a straight or branched, saturated or unsaturated aliphatic hydrocarbon having 4 to about 24 carbon atoms, preferably 8 to 24 carbon atoms, which R group can also contain a heteroatom selected from the group consisting of oxygen, nitrogen and sulfur. Representative examples of such cosurfactants are N-octylerythronamide, N-decylerythronamide, N-dodecylerythronamide, N-tetradecylerythronamide, N-decylxylonamide and N-dodecylxylonamide.

The glyceramide sugar surfactants are generally disclosed in U.S. Pat. No. 5,352,387, the entire contents of which is incorporated herein by reference. These cosurfactants have the general formula VI:

$$HOCH_2CH(OH)C(O)NHR \quad VI$$

wherein R is a $C_8$ to $C_{24}$ straight or branched chained, saturated or unsaturated aliphatic hydrocarbon in which the R group may also be substituted by a heteroatom selected from oxygen, nitrogen and sulfur. Representative examples of such cosurfactants are N-octylglyceramide, N-decylglyceramide and N-hexadecylglyceramide.

The glyceroglycolipid sugar surfactants are generally disclosed in U.S. Pat. No. 5,358,656, and published European Patent Application No. 550,279, the disclosure of each of which is incorporated herein by reference. The glyceroglycolipids can be of the formula VII:

$$A^1—O—CH_2—CH(B)—CH_2NRR_1 \quad VII$$

wherein $A^1$ is a saccharide, preferably having one or more saccharide units, more preferably a mono or disaccharide and most preferably a monosaccharide such as glucose or galactose; R and $R_1$ are the same or different and are hydrogen, a branched or unbranched hydrocarbon radical having from 1 to about 24, preferably from about 6 to about 18 carbon atoms; B is OH or a $NR^2R^3$ group, wherein $R^2$ and $R^3$ may be the same or different and are hydrogen, a branched or unbranched hydrocarbon radical having 1 to 24, preferably from 6 to 18 carbon atoms, and $NRR_1$ and B are positionally interchangeable. Representative examples of such cosurfactants are 3-(butylamino)-2-hydroxypropyl-β-D-galactopyranoside, 3-(octylamino)-2-hydroxypropyl-β-D-galactopyranoside, 3-(eicosylamino)-2-hydroxypropyl-β-D-galactopyranoside, 3-(butylamino)-2-hydroxypropyl-β-D-glucopyranoside, and 3-(pentylamino)-2-hydroxypropyl-β-D-mannopyranoside.

Other glyceroglycolipid surfactants are disclosed in published European Patent Application No. 550,280, which is incorporated herein by reference. These cosurfactants are of the formula VIII:

$$A^1—O—CH_2—CH(OR_1)—CH_2OR \quad VIII$$

wherein $A^1$ is from 1 to 4 saccharide units and more preferably represents a mono or disaccharide, and most preferably a monosaccharide, for example, glucose or galactose; R and $R_1$ are the same or different and are hydrogen, or a branched or unbranched, saturated or unsaturated, hydrocarbon radical having from 1 to 24 carbon atoms, preferably from 6 to 18 carbon atoms. Representative examples of such cosurfactants are 3-(butyloxy)-2-hydroxypropyl-β-D-galactopyranoside, 3-(eicosyloxy)-2-hydroxypropyl-β-D-galactopyranoside, 3-(decyloxy)-2-hydroxypropyl-β-D-galactopyranoside, 3-(butyloxy)-2-hydroxypropyl-β-D-glucopyranoside, 3-(octyloxy)-2-hydroxypropyl-β-D-mannopyranoside, 3-(tetradecyloxy)-2-hydroxypropyl-β-D-lactoside, 3-(octadecyloxy)-2-hydroxypropyl-β-D-maltoside, 3-(octyloxy)-2-hydroxypropyl -β-D-galactotrioside, and 3-(dodecyloxy)-2-hydroxypropyl-β-D-cellotrioside.

The polyhydroxy fatty acid amide sugar surfactants are generally disclosed in U.S. Pat. Nos. 5,174,927, 5,223,179 and 5,332,528, the entire disclosure of each of which is incorporated herein by reference. The polyhydroxy fatty acid amide surfactant component of the present invention comprises compounds of the structural formula IX:

$$R^2C(O)N(R^1)Z \quad IX$$

wherein: $R^1$ is H, $C_1$–$C_4$ hydrocarbyl, 2-hydroxy ethyl, 2-hydroxy propyl or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of —$CH_2$—(CHOH)n—$CH_2OH$, —CH($CH_2OH$)—$(CHOH)_{n-1}$—$CH_2OH$, —$CH_2$—$(CHOH)_2$(CHOR')(CHOH)—$CH_2OH$, where n is an integer from 3 to 5, inclusive, and R' is H or a cyclic or aliphatic monosaccharide, and alkoxylated derivatives thereof. Most preferred are glycityls wherein n is 4, particularly —$CH_2$—$(CHOH)_4$—$CH_2OH$.

In the above Formula $R_1$ can be, for example, N-methyl, N-ethyl, N-propyl, N-isopropyl, N-butyl, N-2-hydroxy ethyl, or N-2-hydroxy propyl.

$R^2C(O)N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Representative examples of such surfactants are N -methyl-N-1-deoxyglucityl cocoamide and N-methyl-N-1-deoxyglucityl tallowamide.

Other suitable polyhydroxy fatty acid amide surfactants (see U.S. Pat. Nos. 5,223,179 and 5,338,491, the entire contents of each which are incorporated herein by reference) are those of the formula X:

$$RC(O)N(R^1)CH_2CH(OH)CH_2OH \qquad X$$

wherein R is a $C_7$–$C_{21}$ hydrocarbyl species, i.e. coconut, tallow, palm fatty alkyl and oleyl, and $R^1$ is a $C_1$ to $C_6$ hydrocarbyl or substituted hydrocarbyl species, i.e. N -alkyl-N-(1,2-propanediol) and N-hydroxyalkyl-N-1,2-propane diol fatty acid amides. Representative examples of such cosurfactants are the tallow amide of 3-[2-(hydroxyethyl) amino]-1,2-propanediol (HEAPD), the palmitate amide of 3-methylamino-1,2-propanediol (MAPD) and the lauramide of MAPD.

According to one embodiment of the present invention, there is provided a novel surfactant blend used for incorporating acyl isethionates, and particularly sodium cocoyl isethionate, into neat soap formulations, for purposes of making personal cleansing formulations. The novel surfactant blend contains: (a) from about 20 to about 63% by weight, and preferably from about 33 to about 56% by weight, of an acyl isethionate salt, preferably sodium cocoyl isethionate; (b) from about 7 to about 23% by weight, and preferably from about 11 to about 20% by weight, of a free fatty acid, preferably a stripped coconut fatty acid; (c) from about 3 to about 52% by weight, and preferably from about 12 to about 21% by weight, of a nonionic sugar surfactant, preferably an alkyl polyglycoside of formula I wherein $R_1$ is an alkyl radical having from about 8 to about 16 carbon atoms, b is zero, and a is an integer having a value of from 1.4 to 1.6; and (d) remainder, water, all weights being based on the total weight of the surfactant blend.

It should be noted that the surfactant blend of the present invention will also preferably contain from about 0.5 to about 3% by weight, and preferably from about 1.5 to about 2.5% by weight, based on the weight of the surfactant blend, of an isethionate salt, such as sodium isethionate, which is a by-product formed during the synthesis of acyl isethionate salts.

According to yet another aspect of the present invention, there is provided a process for incorporating acyl isethionates into neat soap (fatty acid salt) formulations. The process involves combining the above-disclosed novel surfactant blend with a $C_{12}$–$C_{22}$ fatty acid salt (neat soap), wherein both constituents are either in liquid or solid form. In the event that both the soap and surfactant blend are in liquid form, they are combined at a temperature ranging from about 40 to about 95° C. On the other hand, if both the soap and surfactant blend are in solid form, they are combined at a temperature ranging from about 25 to about 60° C.

The acyl isethionate, a non-soap anionic surfactant which is highly mild to human skin, is incorporated into soap by way of the surfactant blend. The term "soap" as used herein refers to alkali metal salts of aliphatic alkane- or alkene monocarboxylic acids, generally known as $C_8$–$C_{22}$ alkyl fatty acids. Sodium and potassium salts are preferred. A particularly preferred soap consists of a mixture of about 60 to 90% tallow fatty acids and 10 to 40% coconut fatty acid.

When incorporating the acyl isethionate into the soap to form a personal cleansing formulation, from about 5 to about 40% by weight, and preferably from about 15 to about 30% by weight, based on the total weight of the personal cleansing formulation, of the surfactant blend is combined with the soap. Due to the fluidity (viscosity) characteristics of the surfactant blend, the acyl isethionate contained therein is easily incorporated into the neat soap formulation in a highly homogeneous fashion.

While it is primarily contemplated to combine both the surfactant blend and soap in liquid form, as was noted above, solid forms thereof may also be used. Thus, the acyl isethionates may be incorporated into solid forms of soap (soap pellets) by drying down the surfactant blend containing the acyl isethionates, i.e., reducing its water content to less than about 5%, and then combining the dried-down surfactant blend with the soap pellets, in the presence of water, in an amalgamator, to form a personal cleansing formulation. The personal cleansing formulation can then be processed into a bar which does not contain any grit.

Thus, the present invention also provides a process for making a personal cleansing bar containing acyl isethionates homogeneously dispersed throughout the personal cleansing bar by combining from about 5 to about 40% by weight, and preferably from about 15 to about 30% by weight, based on the total weight of the personal cleansing composition, of the surfactant blend of the present invention with a neat soap mixture to form a personal cleansing composition. The personal cleansing composition thus formed is then processed into a personal cleansing bar (toilet bar). It should be noted, however, that the personal cleansing composition can also be employed by the consumer in either liquid or gell.

Other performance chemicals and adjuvants may also be added to the personal cleansing composition prior to its processing into final form. The amount of these chemicals and adjuvants added to the personal cleansing composition will range from about 1 to about 5% by weight, based on the total weight of the personal cleansing composition. Examples of chemicals and adjuvants which may be used include, but are not limited to, perfumes, pigments, dyes, preservatives, electrolyte salts, water, and mixtures thereof. Similarly, by-products typically present in commercially available acyl isethionates, such as sodium isethionate, may also be present in the final composition.

The present invention will be better understood from the examples which follow, all of which are intended to be illustrative only and not meant to unduly limit the scope of the invention. Unless otherwise indicated, percentages are on a weight-by-weight basis.

EXAMPLE 1

Preparation of Surfactant Blend:

A surfactant blend in accordance with the present invention was prepared by combining the following components:

| Component | Solids Content |
|---|---|
| (a) sodium cocoyl isethionate | 55.75 |
| (b) coconut fatty acid | 19.80 |
| (c) sodium isethionate | 2.62 |
| (d) PLANTAREN ® 2000N | 20.73 |
| (e) other ingredients | 1.10 |
| | 100.00 |

Preparation of Personal Cleansing Composition:

A personal cleansing composition was prepared by combining 20% by weight of the above-disclosed surfactant blend with 80% by weight of commercial soap pellets, all weights being based on the total weight of the personal cleansing composition. The commercial soap pellets consisted of an 85/15 ratio of sodium tallowate to sodium cocoate. The resulting personal cleansing composition was then processed into bar form. The bars were then submitted to lather panel testing and found to be comparable in lathering performance to commercially available "combo" soap bars containing sodium cocoyl isethionate. Another advantage associated with the novel surfactant blend of the present invention relates to the amount of both acyl isethionate and free fatty acids used in formulating personal cleansing composition. More particularly, whereas commercially available COMBO bars such as LEVER® 2000, sold by Lever Brothers Co., require a 30% replacement of soap with a mixture of acyl isethionate salt and free fatty acid, by using the novel surfactant blend of the present invention, comparable lathering can be obtained by replacing only 20% of the soap with the surfactant blend of the present invention.

What is claimed is:

1. A surfactant composition comprising:

(a) from about 20 to about 63% by weight of an acyl isethionate;

(b) from about 3 to about 52% by weight of a nonionic sugar surfactant selected from the group consisting of alkyl glucose esters, aldobionamides, gluconamides, glyceramides, glyceroglycolipids, polyhydroxy fatty acid amides, alkyl polyglycosides having the general formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and mixtures thereof;

(c) from about 11 to about 23% by weight of a free fatty acid; and (d) remainder, water, all weights being based on the weight of the surfactant composition.

2. The composition of claim 1 wherein the acyl isethionate is sodium cocoyl isethionate.

3. The composition of claim 1 further containing from about 0.5 to about 5% by weight of sodium isethionate.

4. The composition of claim 1 wherein the nonionic sugar surfactant is an alkyl polyglycoside of formula I.

5. The composition of claim 4 wherein in formula I, $R_1$ is an alkyl radical having from about 8 to about 16 carbon atoms, b is zero, and a is a number having a value of from 1.4 to 1.6.

6. The composition of claim 1 wherein the free fatty acid is stripped coconut fatty acid.

7. The composition of claim 1 wherein the nonionic sugar surfactant is a polyhydroxy fatty acid amide.

8. A surfactant composition comprising:

(a) from about 3 to about 56% by weight of sodium cocoyl isethionate;

(b) from about 11 to about 20% by weight of coconut fatty acid;

(c) from about 12 to about 21 % by weight of an alkyl polyglycoside of formula I:

$$R_1O(R_2O)_b(Z)_a \qquad \text{(I)}$$

wherein $R_1$ is a monovalent organic radical having from about 8 to about 16 carbon atoms, b is zero, and a is a number having a value of from 1.4 to 1.6;

(d) from about 1.5 to about 2.5% by weight of sodium isethionate; and (e) remainder, water, all weights being based on the weight of the composition.

9. A process for incorporating an acyl isethionate into a $C_8$–$C_{22}$ fatty acid salt comprising blending the $C_8$–$C_{22}$ fatty acid salt with a surfactant composition, the surfactant composition comprising:

(a) from about 20 to about 63% by weight of an acyl isethionate;

(b) from about 3 to about 52% by weight of a nonionic sugar surfactant selected from the group consisting of alkyl glucose esters, aldobionamides, gluconamides, glyceramides, glyceroglycolipids, polyhydroxy fatty acid amides, alkyl polyglycosides having the general formula I:

$$R_1O(R_2O)_b(Z)_a \qquad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and mixtures thereof;

(c) from about 11 to about 23% by weight of a free fatty acid; and (d) remainder, water, all weights being based on the weight of the surfactant composition.

10. The process of claim 9 wherein the acyl isethionate is sodium cocoyl isethionate.

11. The process of claim 9 wherein the surfactant composition further contains from about 0.5 to about 5% by weight of sodium isethionate.

12. The process of claim 9 wherein the nonionic sugar surfactant is an alkyl polyglycoside of formula I.

13. The process of claim 12 wherein in formula I, $R_1$ is an alkyl radical having from about 8 to about 16 carbon atoms, b is zero, and a is a number having a value of from 1.4 to 1.6.

14. The process of claim 9 wherein the free fatty acid is stripped coconut fatty acid.

15. The process of claim 9 wherein the nonionic sugar surfactant is a polyhydroxy fatty acid amide.

16. The process of claim 9 wherein the $C_8$–$C_{22}$ fatty acid salt and surfactant composition are both in liquid form and are blended at a temperature ranging from about 40 to about 95° C.

17. The process of claim 9 wherein the $C_8$–$C_{22}$ fatty acid salt and surfactant composition, respectively, are blended in a ratio by weight of from about 95:5 to about 60:40.

18. A process for incorporating an acyl isethionate into a $C_8$–$C_{22}$ fatty acid salt comprising blending the $C_8$–$C_{22}$ fatty acid salt with a surfactant composition, the surfactant composition comprising:

(a) from about 33 to about 56% by weight of sodium cocoyl isethionate;

(b) from about 12 to about 21 % by weight of an alkyl polyglycoside having general formula I:

$$R_1O(R_2)_b(Z)_a \quad \text{I}$$

wherein $R_1$ is a monovalent organic radical having from about 8 to about 16 carbon atoms; b is zero; a is a number having a value from 1.4 to 1.6,;

(c) from about 11 to about 20% by weight of a stripped coconut fatty acid;

(d) from about 1.5 to about 2.5% by weight of sodium isethionate; and (e) remainder, water, all weights being based on the weight of the surfactant composition.

19. The process of claim 18 wherein the $C_8$–$C_{22}$ fatty acid salt and surfactant composition are both in liquid form and are blended at a temperature ranging from about 40 to about 95° C.

20. The process of claim 18 wherein the $C_8$–$C_{22}$ fatty acid salt and surfactant composition, respectively, are blended in a ratio by weight of from about 95:5 to about 60:40.

21. A process for making a personal cleansing bar comprising:

(a) providing a $C_{12}$–$C_{22}$ fatty acid salt;

(b) providing a surfactant composition, the surfactant composition comprising:

(i) from about 20 to about 63% by weight of an acyl isethionate;

(ii) from about 3 to about 52% by weight of a nonionic sugar surfactant selected from the group consisting of alkyl glucose esters, aldobionamides, gluconamides, glyceramides, glyceroglycolipids, polyhydroxy fatty acid amides, alkyl polyglycosides having the general formula I:

$$R_1O(R_2O)_b(Z)_a \quad \text{I}$$

wherein $R_1$ is a monovalent organic radical having from about 6 to about 30 carbon atoms; $R_2$ is divalent alkylene radical having from 2 to 4 carbon atoms; Z is a saccharide residue having 5 or 6 carbon atoms; b is a number having a value from 0 to about 12; a is a number having a value from 1 to about 6, and mixtures thereof;

(iii) from about 11 to about 23% by weight of a free fatty acid; and (iv) remainder, water, all weights being based on the weight of the surfactant blend;

(c) combining components (a) and (b) to form a personal cleansing composition; and (d) processing the personal cleansing composition into a bar.

22. The process of claim 21 wherein the acyl isethionate is sodium cocoyl isethionate.

23. The process of claim 21 wherein the surfactant composition further contains from about 0.5 to about 5% by weight of sodium isethionate.

24. The process of claim 21 wherein the nonionic sugar surfactant is an alkyl polyglycoside of formula I.

25. The process of claim 24 wherein in formula I, $R_1$ is an alkyl radical having from about 8 to about 16 carbon atoms, b is zero, and a is a number having a value of from 1.4 to 1.6.

26. The process of claim 21 wherein the free fatty acid is stripped coconut fatty acid.

27. The process of claim 21 wherein the nonionic sugar surfactant is a polyhydroxy fatty acid amide.

28. The process of claim 21 wherein the $C_8$–$C_{22}$ fatty acid salt and surfactant composition are both in liquid form and are blended at a temperature ranging from about 40 to about 95° C.

29. The process of claim 21 wherein the $C_8$–$C_{22}$ fatty acid salt and surfactant composition are both in solid form and are blended at a temperature ranging from about 25 to about 60° C.

30. The process of claim 21 wherein the $C_8$–$C_{22}$ fatty acid salt and surfactant composition, respectively, are blended at a ratio by weight ranging from about 95:5 to about 60:40.

31. A process for making a personal cleansing bar comprising;

(a) providing a $C_8$–$C_{22}$ fatty acid salt;

(b) providing a surfactant composition, the surfactant composition comprising:

(i) from about 33 to about 56% by weight of a sodium cocoyl isethionate;

(ii) from about 12 to about 21% by weight of an alkyl polyglycoside having the general formula I:

$$R_1O(R_2O)_b(Z)_a \quad \text{I}$$

wherein $R_1$ is a monovalent organic radical having from about 8 to about 16 carbon atoms; b is zero; a is a number having a value from 1.4 to 1.6;

(iii) from about 11 to about 20% by weight of a stripped coconut fatty acid;

(iv) from about 1.5 to about 2.5% by weight of sodium isethionate; and (v) remainder, water, all weights being based on the weight of the surfactant blend;

(c) combining components (a) and (b) to form a personal cleansing composition; and (d) processing the personal cleansing composition into a bar.

32. The process of claim 31 wherein the $C_8$–$C_{22}$ fatty acid salt and surfactant composition are both in liquid form and are blended at a temperature ranging from about 40 to about 95° C.

33. The process of claim 31 wherein the $C_8$–$C_{22}$ fatty acid salt and surfactant composition are both in solid form and are blended at a temperature ranging from about 25 to about 60° C.

34. The process of claim 31 wherein the $C_8$–$C_{22}$ fatty acid salt and surfactant composition, respectively, are blended at a ratio by weight ranging from about 95:5 to about 60:40.

* * * * *